US007685746B2

(12) United States Patent
Kipnes et al.

(10) Patent No.: US 7,685,746 B2
(45) Date of Patent: Mar. 30, 2010

(54) PEDICURE BOOT

(75) Inventors: Deanna H. Kipnes, Marlboro, NJ (US); Germain Poulin, Ancienne-Lorette (CA)

(73) Assignee: Tres Chicas, LLC, Marlboro, NJ (US)

( * ) Notice: Subject to any disclaimer, the term of this patent is extended or adjusted under 35 U.S.C. 154(b) by 897 days.

(21) Appl. No.: 11/503,097

(22) Filed: Aug. 11, 2006

(65) Prior Publication Data

US 2007/0017126 A1 Jan. 25, 2007

Related U.S. Application Data

(63) Continuation-in-part of application No. 11/105,888, filed on Apr. 14, 2005, now Pat. No. 7,296,367.

(51) Int. Cl.
*A43B 7/26* (2006.01)

(52) U.S. Cl. ..... 36/94; 36/105; 36/101

(58) Field of Classification Search ..... 36/94, 36/105, 101, 72 R, 100
See application file for complete search history.

(56) References Cited

U.S. PATENT DOCUMENTS

| | | | | |
|---|---|---|---|---|
| 2,178,885 | A * | 11/1939 | Buff et al. | 24/382 |
| 2,444,640 | A * | 7/1948 | Epstein | 36/101 |
| 2,507,120 | A | 5/1950 | Shapiro | |
| 3,329,972 | A | 7/1967 | Schwab et al. | |
| 4,217,706 | A * | 8/1980 | Vartanian | 36/110 |
| 4,599,811 | A * | 7/1986 | Rousseau | 36/105 |
| 4,773,170 | A * | 9/1988 | Moore et al. | 36/110 |
| 5,176,624 | A * | 1/1993 | Kuehnreich | 602/65 |
| D362,744 | S * | 10/1995 | McGuire | D2/905 |
| 5,926,978 | A * | 7/1999 | Smith | 36/101 |
| 6,272,773 | B1 * | 8/2001 | Sjosvard | 36/131 |
| D449,152 | S | 10/2001 | Besko | |
| 6,874,255 | B2 | 4/2005 | Bernstein | |
| 2006/0064902 | A1 | 3/2006 | Ashton | |

FOREIGN PATENT DOCUMENTS

| | | | |
|---|---|---|---|
| EP | 327258 | A2 | 9/1989 |

* cited by examiner

*Primary Examiner*—Ted Kavanaugh
(74) *Attorney, Agent, or Firm*—Watov & Kipnes, P.C.

(57) ABSTRACT

The present invention is directed to a pedicure boot having a forward end of an upper member detachably secured to the forward end of the sole member to enable the toes of the user to be exposed and then covered as needed without having the forward end of the upper member detached from the pedicure boot.

9 Claims, 13 Drawing Sheets

PEDICURE BOOT

RELATED APPLICATION

This is a continuation-in-part application of U.S. patent application Ser. No. 11/105,888 filed Apr. 14, 2005 now U.S. Pat. No. 7,296,367.

FIELD OF THE INVENTION

The present invention is generally directed to a pedicure boot which can be worn as a protective boot, particularly in cold or inclement weather upon arrival and while leaving a pedicure salon. When the pedicure is provided, the forward end of the pedicure boot may be adjusted to temporarily expose the toes so that the pedicure operator may provide a pedicure and then repositioned to protect the toes, especially in cold or inclement weather.

BACKGROUND OF THE INVENTION

Pedicure salons are well known and are frequented predominantly by women. In warm weather, it is commonplace for the procurer of a pedicure to arrive at the pedicure salon in open toe sandals which can be easily removed or remain on the user during the pedicure. When the pedicure is completed, there is often a period of time, typically up to one hour in which the polish applied to the toes must have ample time to dry.

Accordingly, it is commonplace for the procurer of a pedicure to arrive at a pedicure salon in open toe sandals. The sandals may be removed during the pedicure and then placed again on the feet after the pedicure is completed without adversely affecting the nail polish applied to the toes. The user can then wear the open toe sandals when leaving the pedicure salon even if the nail polish is not completely dry because the toes and particularly the nail polish applied thereto do not come into contact with any portion of the open toe sandals. This system works well in warm temperatures and under good weather conditions.

However, when the outside temperature decreases (e.g. from early to mid-Fall through early-Spring and particularly during the Winter) or during inclement weather such as rain or snow the use of an open toe sandal especially after leaving a pedicure salon is problematical. Once the pedicure is completed, the user must remain in the pedicure salon until the nail polish is completely dry which can take up to an hour. Because the open toe sandal provides no protection against cold or inclement weather, any attempt to leave the pedicure salon with an open toe sandal can result in significant discomfort to the user and can adversely affect the pedicure itself. Exposure to cold becomes very uncomfortable for the user and may even expose the user to a chill resulting in sickness because of the complete exposure of the lower portion of the foot that takes place when wearing open toe sandals.

Examples of pedicure sandals are shown in U.S. Pat. Nos. 2,751,693; 5,946,823; and 6,678,971. Each of these pedicure sandals show significant exposure of the foot in order to allow the polished toes ample opportunity to dry. In each case, not only are the toes exposed, but a substantial part of the foot and upper ankle are exposed to the elements as well.

U.S. Pat. No. 5,946,823 shows a pedicure sandal system in which the toes are protected by a removable cover assembly that can slip over the forward end of the sandal and is completely removable therefrom. A problem with pedicure sandal systems of this type is that the cover assembly must be completely removed to expose the toes and therefore forms an entirely separate unit from the sandal itself. Thus, there is always the possibility of losing or misplacing the toe cover assembly rendering the sandal useless for protecting the toes.

It would be a significant advance in the art of pedicure systems to provide a pedicure boot which minimizes exposure of the toes after completion of the pedicure and provides protection to the user, particularly when having to leave pedicure salons in cold or inclement weather.

It would be a further advance in the art of pedicure systems to provide a pedicure boot in which exposure of the toes can be occasioned by adjusting the forward end of the boot in a manner which does not cause complete detachment of the forward end such as described in U.S. Pat. No. 5,946,823.

SUMMARY OF THE INVENTION

The present invention is generally directed to a pedicure boot which employs a sole member preferably a resilient sole member operatively engaged to an upper member and when so engaged forms a foot receiving space. The boot has a forward end which can be adjusted from a position exposing the toes to another position in which the toes are not exposed without having any portion of the boot totally detached therefrom.

In a particular aspect of the present invention, there is provided a pedicure boot comprising:

a) a sole member having a forward end;

b) an upper member operatively engaged to the sole member to form a foot receiving space, said upper member having a forward end releasably engageable to the forward end of the sole member while a remaining portion of the upper member remains engaged to the sole member, said forward end of the upper member being movable from a first position in engagement with the forward end of the sole member to a second position disengaged from the forward end of the sole member to thereby expose a toe portion of a user's foot; and c) first attachment means for releasably engaging the forward end of the upper member to the forward end of the sole member in said first position.

In another embodiment of the invention there is also provided an engagement means for engaging the forward end of the upper member to another position on the upper member while the upper member is in the second position disengaged from the sole member.

In another aspect of the invention, the pedicure boot has a rear portion with an opening for receiving the foot, the rear portion comprising a second attachment means for reversibly separating the rear portion into separated components to facilitate entry of the foot into the pedicure boot.

In a further aspect of the invention, the upper member disengages from the sole member not only at the front end of the boot but along one side thereof thus combining the functions of selectively exposing the toes and facilitating placement of the user's foot in the boot.

In this particular aspect of the present invention, there is provided a pedicure boot comprising:

a) a sole member having a forward end and a side portion;

b) an upper member operatively engaged to the sole member to form a foot receiving space, said upper member having a forward end and a side portion releasably engageable to the forward end and side portion of the sole member while a remaining portion of the upper member remains engaged to the sole member, said forward end of the upper member being movable from a first position in engagement with the forward end of the sole member to a second position disengaged from the forward end of the sole member to thereby expose a toe portion of the user's foot; and c) first attachment means for releasably engaging the forward end and the side portion of the upper member to the forward end and side portion of the sole member in said first position.

In a further aspect of the invention, the upper member is formed in two parts including a forward portion which serves as a cover for the toes in one position and is movable to another position which serves as a platform for the toes when the toes are exposed.

In a particular aspect of this embodiment, the upper member comprises a forward portion which is separated from a corresponding rearward portion so that the forward portion may be raised or lowered while remaining attached to the sole member. When the forward portion is lowered, the user's foot can rest on the forward portion thereby exposing the toes. When the forward portion is raised, the forward portion and the rearward portion together form a foot receiving space in which the toes are not exposed.

In a further particular aspect of this embodiment there is provided a pedicure boot comprising a sole member and an upper member permanently operatively engaged to the sole member to form a foot receiving space; said upper member comprising a forward portion and a rearward portion, said forward portion movable from a raised position covering a toe portion of the user's foot to a lowered position wherein the toe portion of the user's foot rests on the toe portion thereby exposing the toe portion during a pedicure treatment.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

The present invention is generally directed to a pedicure boot which provides full protection of a boot while enabling the front portion of the boot to be moved to a position exposing the toes to enable the application of a pedicure and particularly nail polish and then to provide protection for the user when leaving a pedicure salon much greater than that afforded by open toe pedicure sandals.

Figure 1:
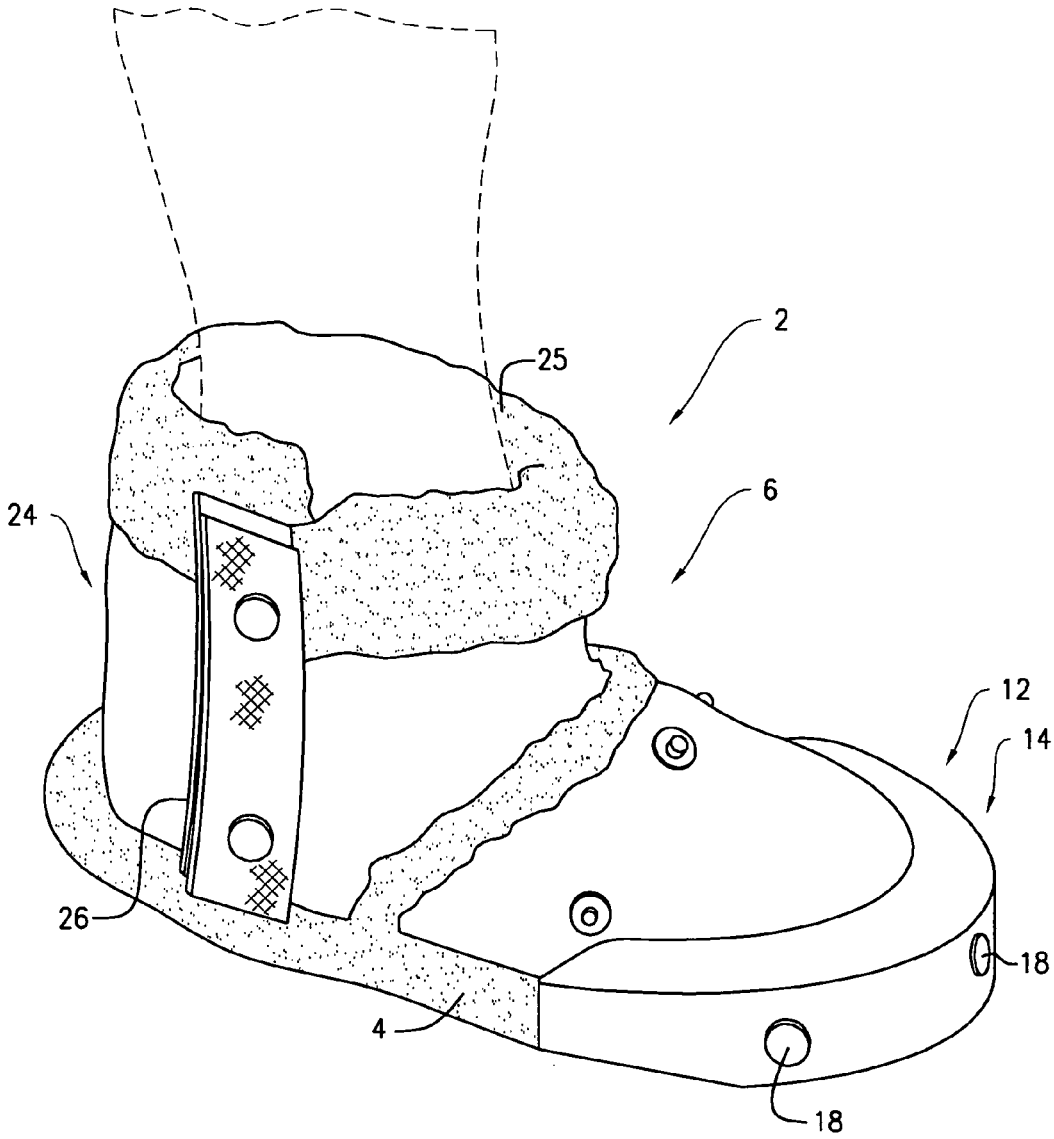
FIG. 1 is a side elevational view of an embodiment of the pedicure boot of the present invention.
Figure 2A:
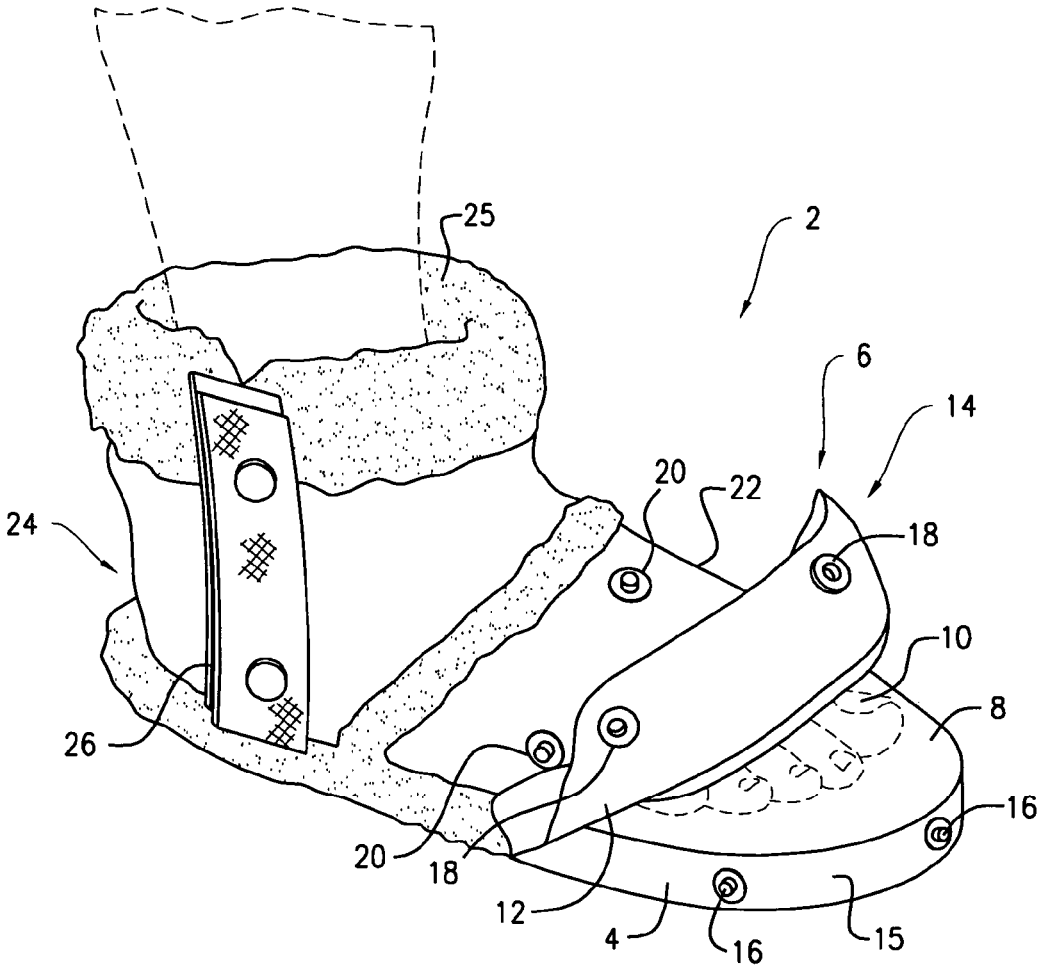
FIG. 2*a* is a perspective view of the embodiment of the invention shown in FIG. 1 with the forward end of the upper member disengaged from the sole member to expose the toes.
Figure 2B:
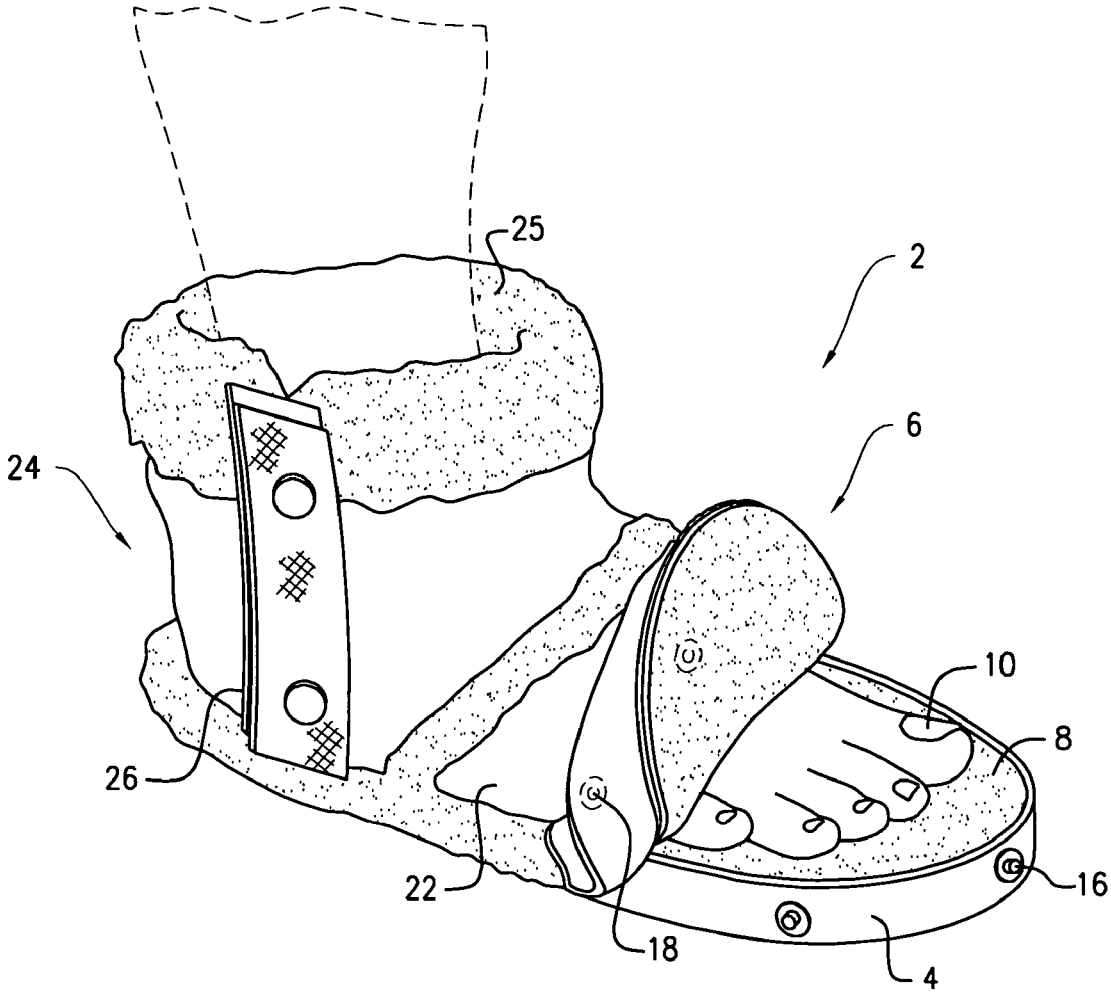
FIG. 2*b* is a perspective view similar to FIG. 2*a* in which the forward of the upper member is secured in place to expose the toes.
Figure 3:
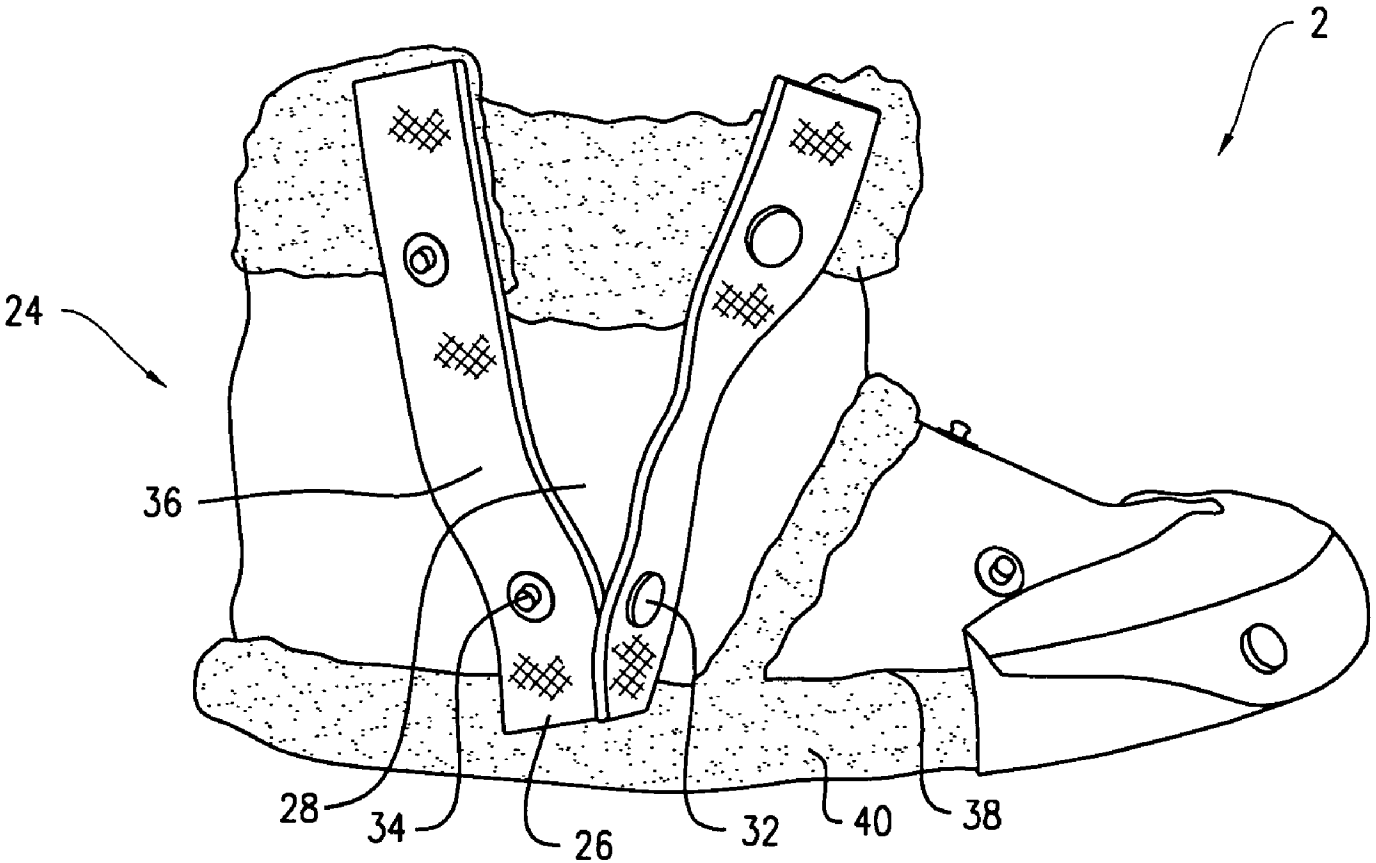
FIG. 3 is a side elevational view of the embodiment of FIG. 1 showing a second portion of the upper member in a position to allow easy access of the user's foot into the pedicure boot.

Referring to the drawings and particularly to FIGS. 1-3, there is shown an embodiment of a pedicure boot 2 in accordance with the present invention in which the forward ends of the sole member and an upper member are engageable to expose and then protect the toes during and after a pedicure. The pedicure boot 2 is comprised of a sole member 4 and an upper member 6. As shown for example in FIGS. 2*a* and 2*b*, the sole member 4 forms with the upper member 6, a foot receiving surface 8 therebetween for receiving the foot of the user and particularly the toes identified by reference numeral 10.

The upper member 6 has a forward end 12 which provides a protective cover for the front portion of the foot of the user and particularly the toes. There is provided at the forward end 12 a first attachment assembly 14 which secures the forward end 12 of the upper member 6 to the forward end 15 of the sole member 4 (see FIG. 2*a*) as discussed below.

The first attachment assembly 14 can be any attachment device that can provide removable attachment of the forward end 12 of the upper member 6 to the forward end 15 of the sole member 4. Preferred examples of the first attachment assembly 14 are hook and eye assemblies (e.g. Velcro®) and male and female snap members.

In the embodiment shown specifically in FIGS. 1-3, the first attachment assembly 14 comprises male and female snap members 16 and 18, respectively. The male snap members 16 (see FIG. 2*a*) are attached to the forward end 15 of the sole member 4 and are engageable to corresponding female snap members 18 appearing on the underside of the forward end 12 of the upper member 6. Engagement of the male snap member 16 to the female snap member 18 places the forward end 12 of the upper member 6 in a toe covering or first position as shown in FIG. 1 wherein the toes are covered by the front end of the pedicure boot.

Disengagement of the female snap member 18 from the male snap member 16 enables the forward end 12 to be lifted to a second position exposing the toes 10 as best shown in FIGS. 2*a* and 2*b*. The forward end 12 may be secured in the second or toe exposing position shown in FIG. 2*b* by engagement of a first engaging device in the form of the female snap members 18 with a second engaging device in the form of male snap members 20 appearing on a rearward portion 22 of the forward end 12 of the upper member 6. Thus, the forward end 12 forms a flap movable from the first position shown in FIG. 1 covering the toes to a position shown in FIGS. 2*a* and 2*b* exposing the toes while the pedicure boot remains on the user's foot.

It will be understood that the first attachment assembly 14, exemplified using engageable snap members (16, 18 and 20)

can readily be replaced by other attachment assemblies enabling removable attachment as described above including Velcro® and the like. It will be further understood that the position of the male and female snap members can be reversed (i.e. the male snap member can be placed on the underside of the forward end 12 and the female snap member can be placed on the forward end of the sole member). In addition, the particular method of attachment employed for the first attachment assembly can also be used to engage the forward end of the upper member in the toe exposing position.

In operation, the user can place the pedicure boot 2 on the foot and employ the boot as any other type of shoe device. When a pedicure is to be applied, the user may remove the boot or may disengage the forward end 12 of the upper member 6 by releasing the female snap member 18 from the male snap member 16 to thereby disengage the forward end 12 of the upper member 6 from the forward end 15 of the sole member 4. The forward end 12 may be secured in the toe exposing position shown in FIG. 2*b* by a suitable means such as by engaging the female snap member 18 with the male snap member 20 appearing at the rearward portion 22 of the forward end 12.

When the pedicure is complete, the user may leave the pedicure salon with the toes exposed and the forward end 12 in the position shown in FIG. 2*a*. It will be noted, that unlike opened toe sandals, only the toe portion of the user's foot is exposed to the atmosphere. The remainder of the foot is completely covered by the pedicure boot thereby providing greater protection against cold and inclement weather particularly in the winter than provided by open toe sandal pedicure systems.

The pedicure boot of the present invention may be provided with a further attachment assembly enabling the foot to be more easily inserted into the boot. Referring again to FIGS. 1-3, the pedicure boot 2 has a rear portion 24 having an opening 25 for receiving the foot so that it can be placed in the foot receiving space 8 shown in FIG. 2*a*.

The rear portion may have a second attachment assembly 26 in which the rear portion may reversibly be disengaged into separated components to form a longitudinally disposed opening 28 (see FIG. 3) enabling the opening 25 to be expanded to facilitate entry of the foot into the boot. The second attachment assembly 26 can comprise any attachment device including those described for the first attachment assembly 14.

In the embodiment shown in FIGS. 1-3, the second attachment assembly 26 includes male snap members 32 and female snap members 34 shown best in FIG. 3 which may be adhered to an attachment assembly supporting substrate 36 such as a material suitable for attachment to the boot including leather, cloth, plastic and the like.

In operation, the second attachment assembly 26 may be disengaged by separating the male snap member 34 from the female snap members 32 to assume the position shown in FIG. 3 thereby facilitating entry of the foot into the boot.

It will be noted that the first attachment assembly 14 and the second attachment assembly 26 are separated from each other such that a portion of the upper member shown by the numeral 38 and the sole member shown by the numeral 40 remain permanently attached to each other. These permanent attached portions 38/40 appear on both sides of the boot (only one side is shown in FIG. 3). Thus, the first and second attachment assemblies 14/28 are separate from each other and their separate and distinct functions can be performed independently.

Figure 4:
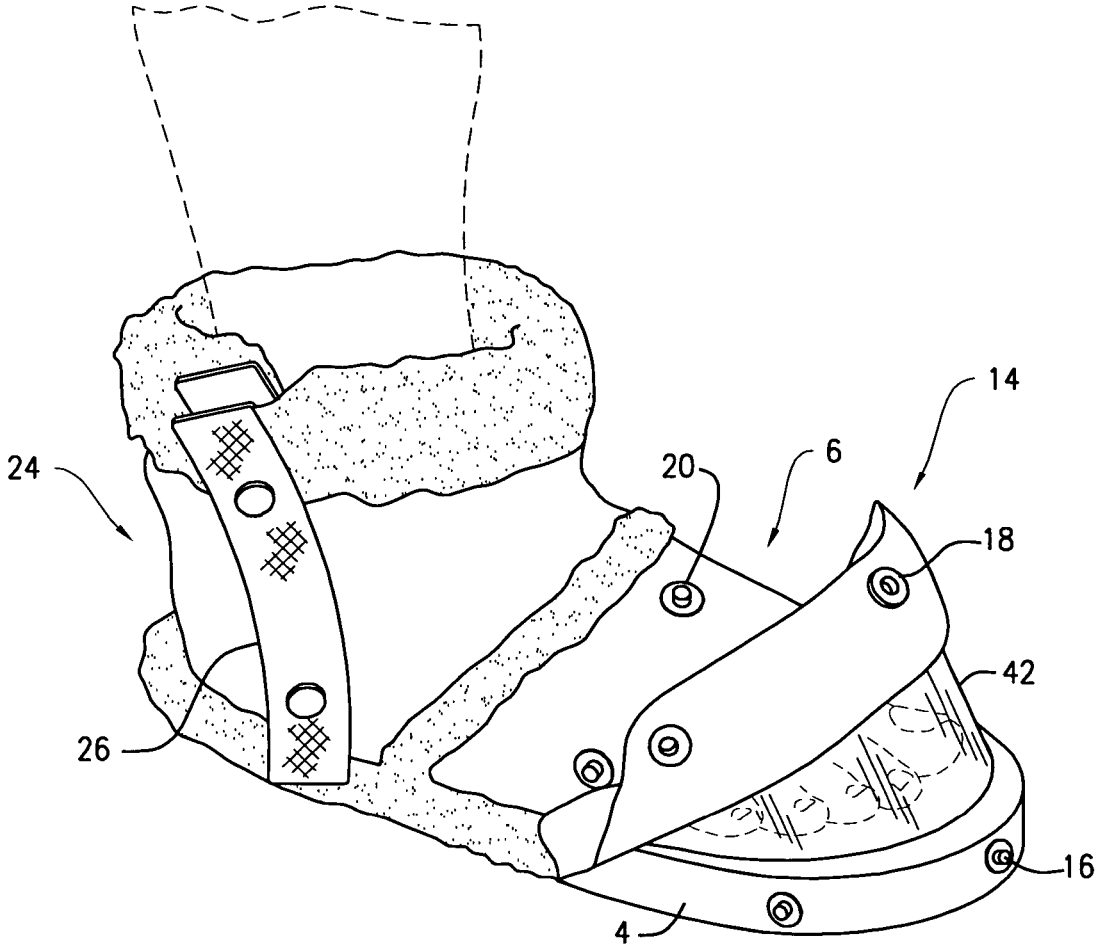
FIG. 4 is a perspective view of another embodiment of the pedicure boot in which a shield assists in preventing the front end of the upper member from touching the toes.

In a further embodiment of the invention, the forward end 12 of the upper member 6 may be assembled to provide greater clearance between the toes and the forward end 12 so that the toes may be completely covered even when the nail polish applied to the toes is still not completely dry. This embodiment is shown in FIG. 4 in which the forward portion of the boot is provided with a rigid member 42 which raises the elevation of the forward end to provide sufficient clearance above the toes.

The rigid member 42 may be attached to the under side of the forward end 12 of the upper member 6 or the forward end 15 of the sole member 4. The operation of the forward end 12 engaging the forward end 15 through the first attachment assembly 14 is conducted in the same manner as described above with sufficient clearance to cover the rigid member 42. Thus, the toes may be covered and exposed in the same manner as described in FIGS. 1-3.

As previously indicated the embodiments of the invention shown in FIGS. 1-3 provide separate attachment assemblies 14 and 26, respectively. These assemblies are separated by a permanent attachment obtained by the permanent attachment of a portion 38 of the upper member 6 and a corresponding portion 40 of the sole member 4 on each side of the boot. In a further embodiment of the invention, the permanent attachment portion on one side of the boot is eliminated so that the respective attachment assemblies can be opened and closed essentially together and their respective functions performed simultaneously.

Figure 5:
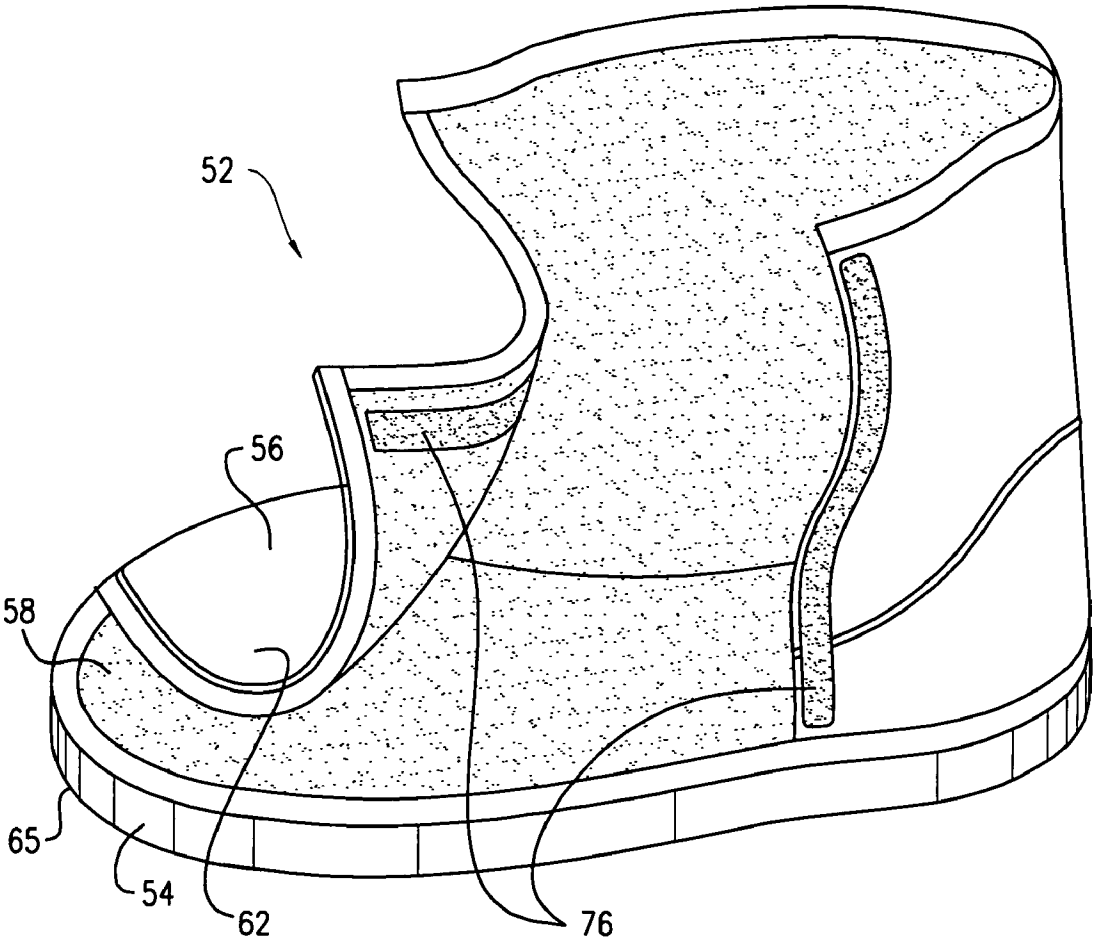
FIG. 5 is a side elevational view of a further embodiment of the pedicure boot in which the forward end and side portion of the upper member is disengaged from the front end and side portion of the sole member to free the toes and provide easy access into and out of the pedicure boot.
Figure 6:
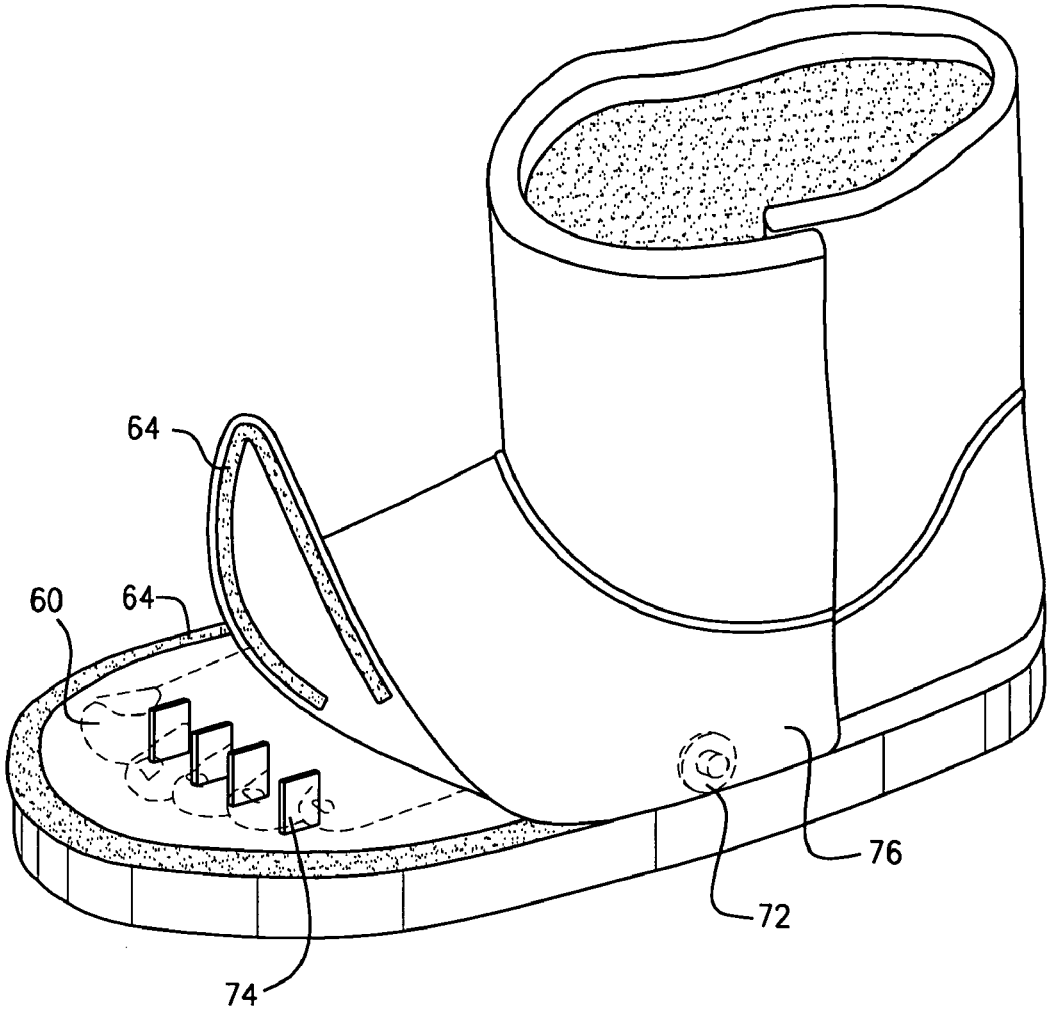
FIG. 6 is a side elevational view of a further embodiment of the pedicure boot of the present invention showing the toes separated by toe spacers.

Referring generally to FIGS. 5-8 and first to FIG. 5, there is shown a pedicure boot 52 of the present invention having a sole member 54 and an upper member 56 defining a foot receiving space 58 for receiving toes 60 (see FIG. 6). The boot has a forward end 62 for the upper member and a forward end 65 for the sole member which when engaged together provide a covering for the toes as previously described.

There is provided a first attachment assembly 64 (shown best in FIG. 6) for engaging the respective forward ends of the upper and sole members exemplified by the use of a hook and eye assembly and a second attachment assembly 76 similar to the attachment assembly 26 previously described for facilitating access of the foot into the boot. However, unlike the embodiments of FIGS. 1-3, there is no permanent attachment between the respective attachment assemblies 64 and 76 on one side of the pedicure boot. Thus, in a single continuous motion, the user can disengage the first attachment assembly 64 to uncover the toes and disengage the second attachment assembly 76 to facilitate entry of the foot into the boot.

In this embodiment it is possible to eliminate the attachment of the forward end 12 of the upper member 6 to the rearward portion 22 of the forward end 12 as previously described. It will be noted that the specific attachment device shown in FIG. 5 is a hook and eye attachment device such as Velcro®.

Figure 7:
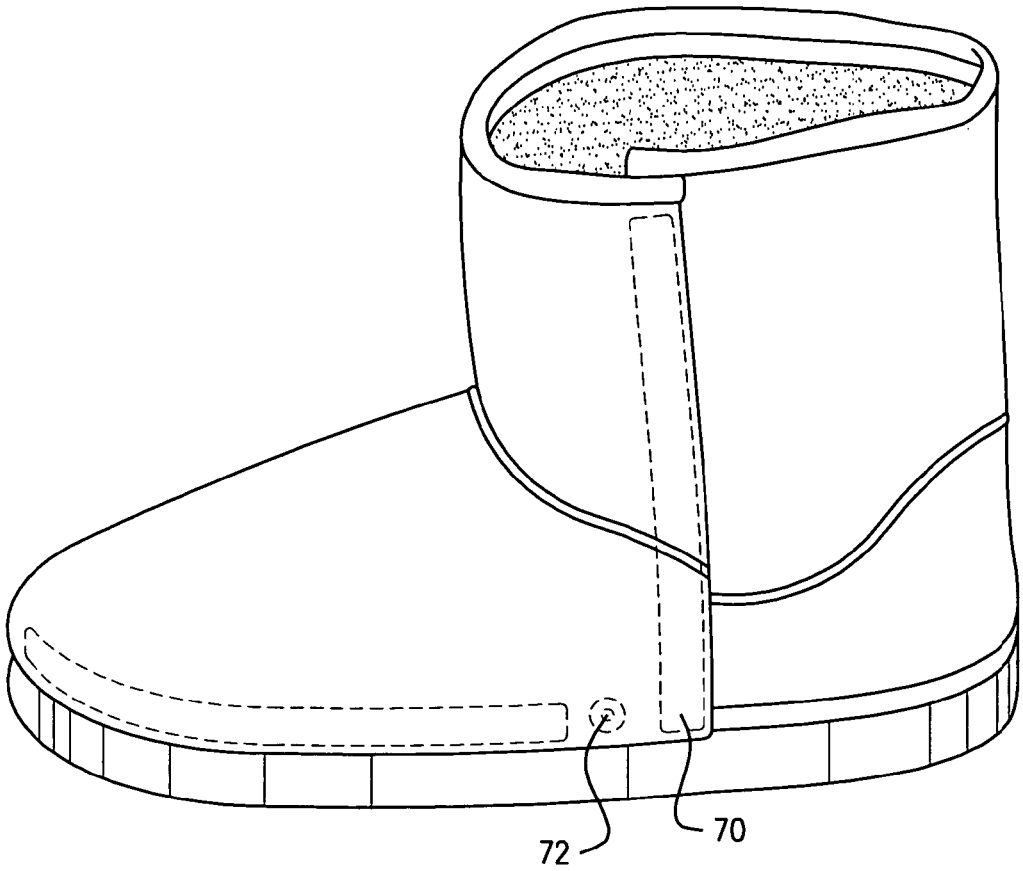
FIG. 7 is a side elevational view of an embodiment of the pedicure boot with the front end portion of the upper member in place covering the toes and the second portion of the upper member secured in place about the user's foot.

In the embodiment shown specifically in FIGS. 6 and 7, the first attachment assembly 64 is shown where the attachment device is a hook and eye assembly and the second attachment device employs the combination of a hook and eye assembly shown by the numeral 70 and a snap member assembly 72 comprised of male and female snap members as previously described.

In a still further embodiment of the invention, there is provided toe spacer's providing spaces between the toes that are particularly helpful in insuring that the toes do not come into contact with each other after completion of a pedicure treatment. The toe spacers can take a variety of forms including those shown in U.S. Pat. Nos. 5,946,823 and 6,678,971, incorporated herein by reference.

Figure 8:
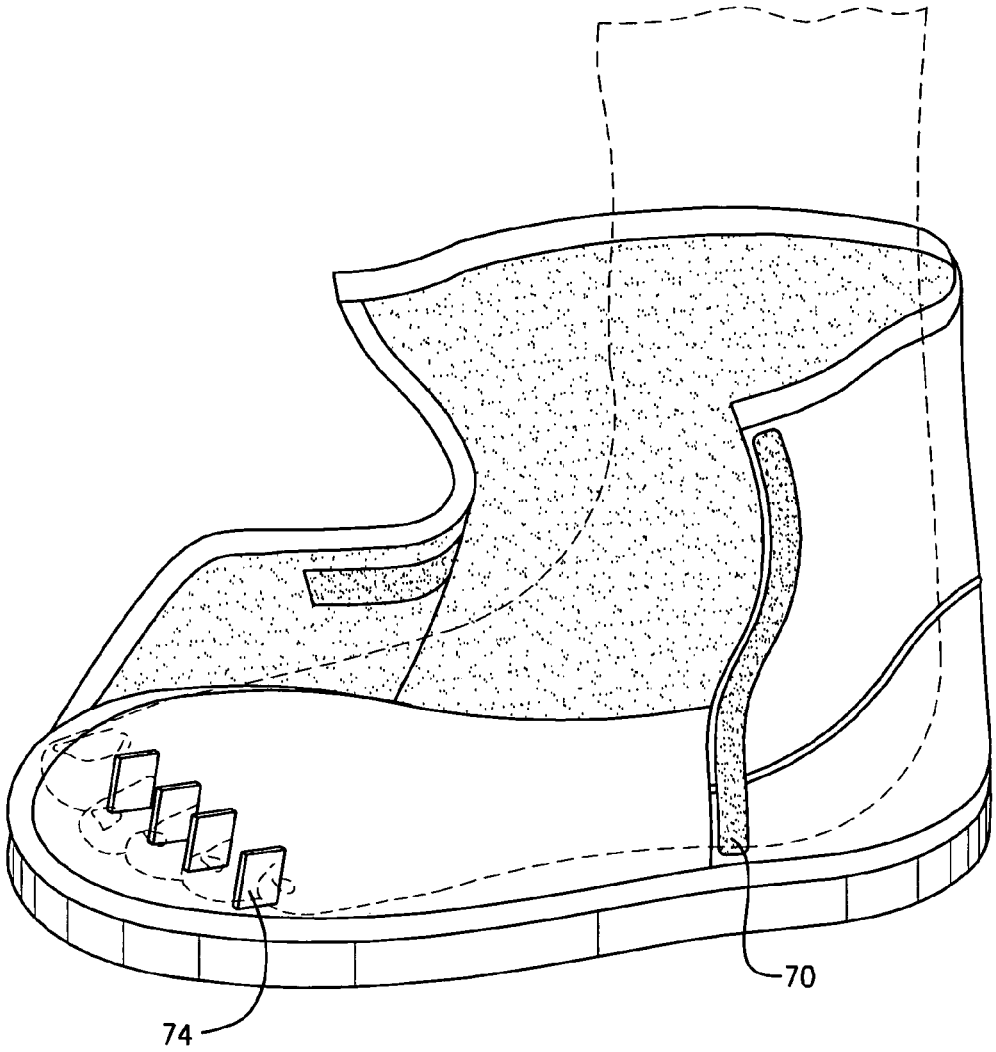
FIG. 8 is a side elevational view of the embodiment of FIG. 5 showing the user's foot within the pedicure boot and the toes spaced apart by toe spacers.

Referring to FIGS. 6 and 8, toes spacers 74 are spaced apart to provide spaces between the toes to insure that the toes are protected while drying from any accidental contact with each other. The toes spacers can be made from any suitable material such as plastic, metal and the like. The spacers may be in the form upstanding members as shown specifically in the drawing figures or may be comprised of raised portions of the sole member.

In a further embodiment of the invention, the pedicure boot has an upper member separated into two portions in which a forward portion is movable from a position proximate to a rearward portion thus forming to toe receiving space whereby the toes are covered by the upper member, to a position in which the forward portion and rearward portion are separated with the toes resting on the forward portion thereby exposing the toes. In this embodiment, as with the previously described embodiments, the upper member remains attached to the sole member.

Referring to FIGS. 9-12, there is shown a further embodiment of a pedicure boot 102 in accordance with the present invention in which an upper member 106 is operatively engaged to a sole member 104 but is separated into two portions, a forward portion 108 and a rearward portion 110. It can be observed from FIG. 9 that as with the other embodiments of the present invention, the upper member including forward portion 108 and rearward portion 110 are operatively engaged to the sole member 104 so that at no time is the front of the boot which covers the toes completely disengaged from the rest of the boot.

Figure 9:
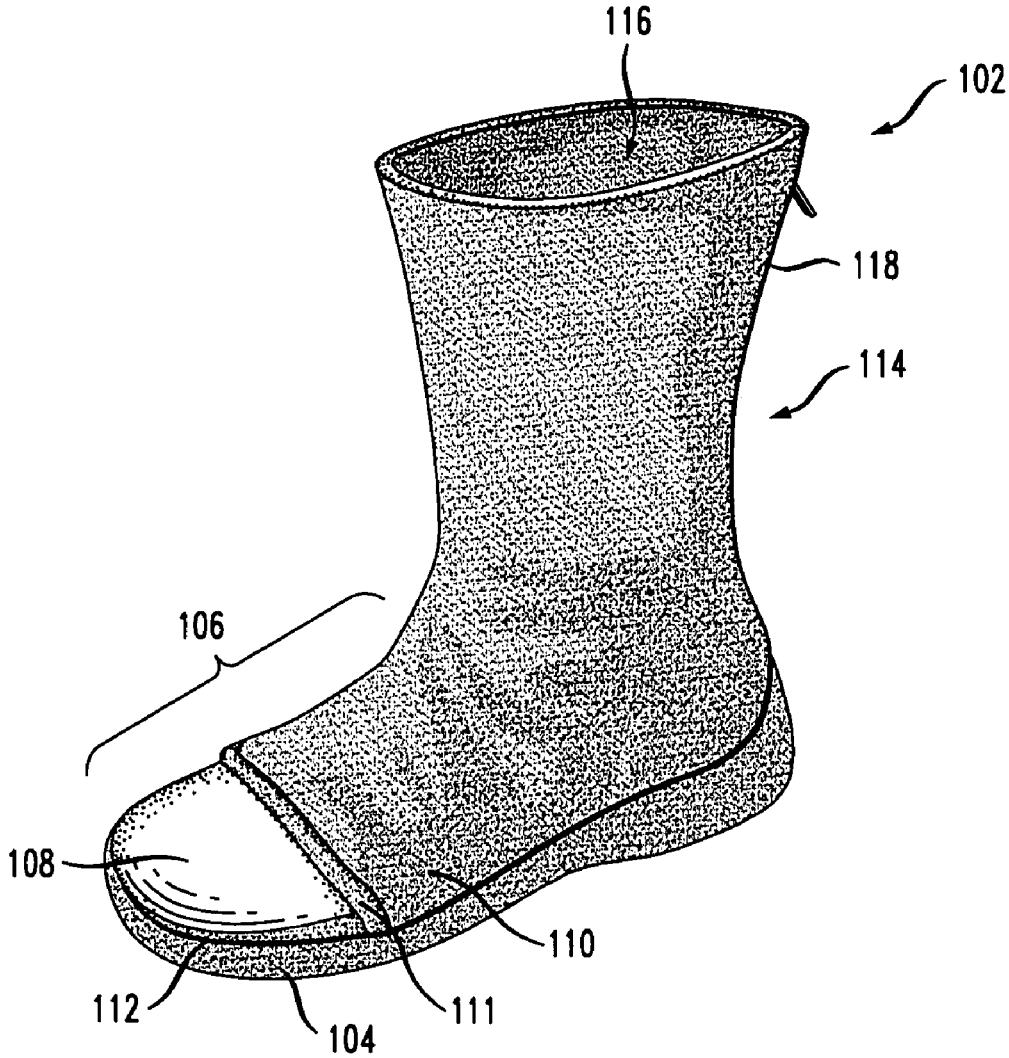
FIG. 9 is a side view of a further embodiment of the invention showing the forward portion of the upper member in a raised position with the toes covered.

Referring particularly to FIG. 9, the forward portion 108 of the upper member 106 is secured to the sole member 104 in the region of the toe portion 112 of the pedicure boot 102. In the position shown in FIG. 9, the forward portion is proximate to the rearward portion 110 and a portion of the forward portion 108 extends under the rearward portion 110 thereby forming an overlap portion 111. The result is a continuous extension of the upper member 106 providing a toe receiving space between the upper member 106 and the sole member 104 wherein the toes are not exposed. The length of the overlap portion can vary so long as the overlap portion is sufficient to provide complete coverage of the toes when the upper member 106 is in the position shown in FIG. 9. Typically, the length of the overlap portion will be up to one inch.

The forward portion 108 may, but need not be, made of a material different than the rearward portion 110 and the remaining part of the pedicure boot 102. This is an optional feature of the present invention. As will be explained hereinafter, it is desirable for the material forming the forward portion 108 to be made of a material which is resistant to wear and does not readily stain, especially from nail polish and nail polish remover. Examples of suitable materials for the forward portion 108 including patent leather, coated leather, plastic materials, rubberized materials and the like.

Continuing with FIG. 9, the pedicure boot 102 has an anterior portion 114 having an opening 116 therein for receiving the foot of the user. Also provided is an attachment assembly 118 shown in the form of a zipper 120 (shown best in FIGS. 11 and 12) in which the anterior portion 114 of the boot may be reversibly disengaged into separated components to form a longitudinally disposed opening 122 (see FIGS. 11 and 12) enabling the opening 116 to be expanded to facilitate entry of the foot into the boot. The attachment assembly 118 can comprise any attachment device such as zippers, hook and eye assemblies (Velcro®); and male and female snap members.

In a preferred embodiment, the attachment assembly 118 extends from the top of the boot in proximity to the opening 116, down the full length of the boot as close as possible to the sole member 104. This enables maximum flexibility to the user when placing the foot in and out of the boot, especially when nail polish is still not completely dry after receiving a pedicure.

Figure 11:
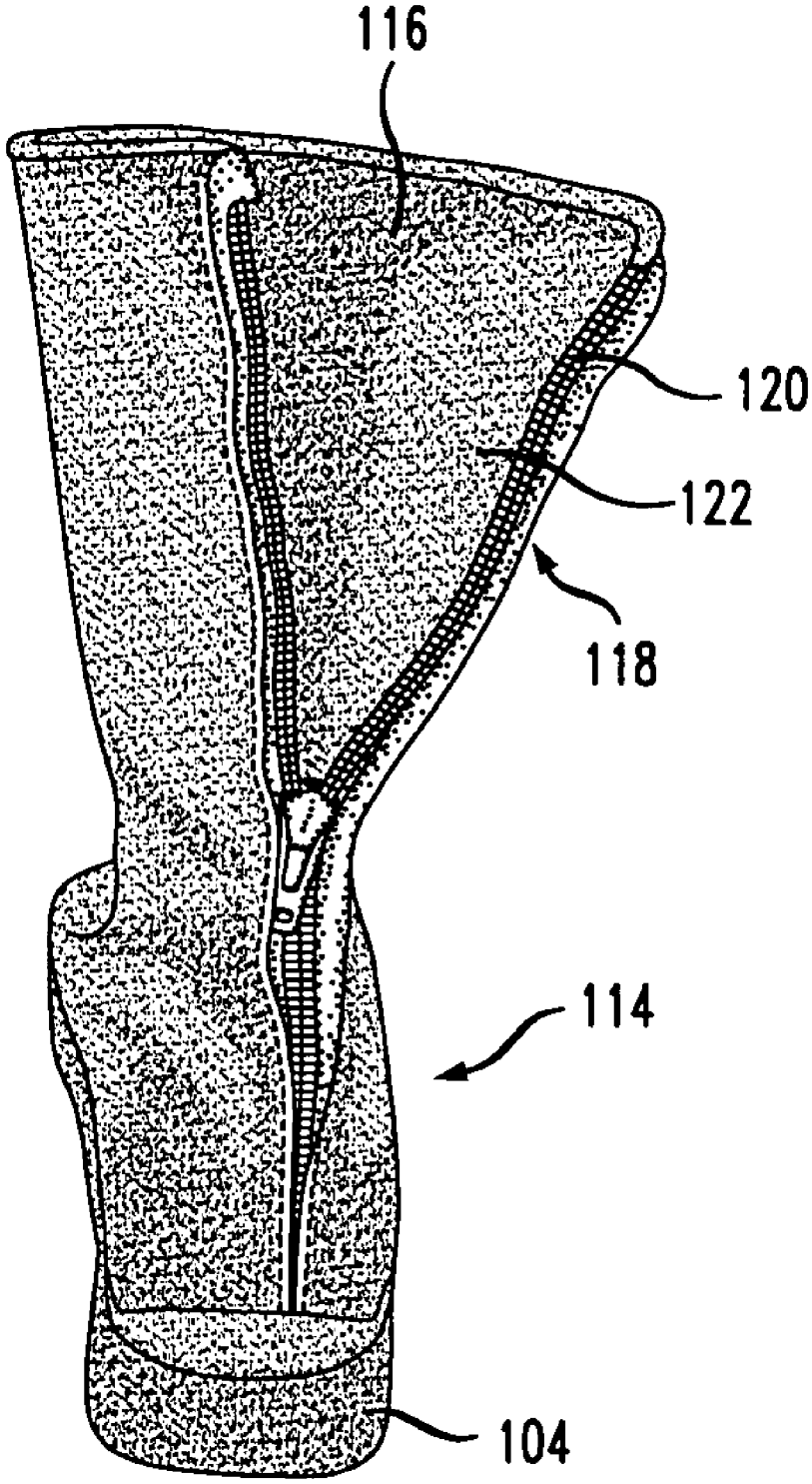
FIG. 11 is a rear view of the embodiment shown in FIG. 9 with a zipper positioned in a partially open position.
Figure 12:
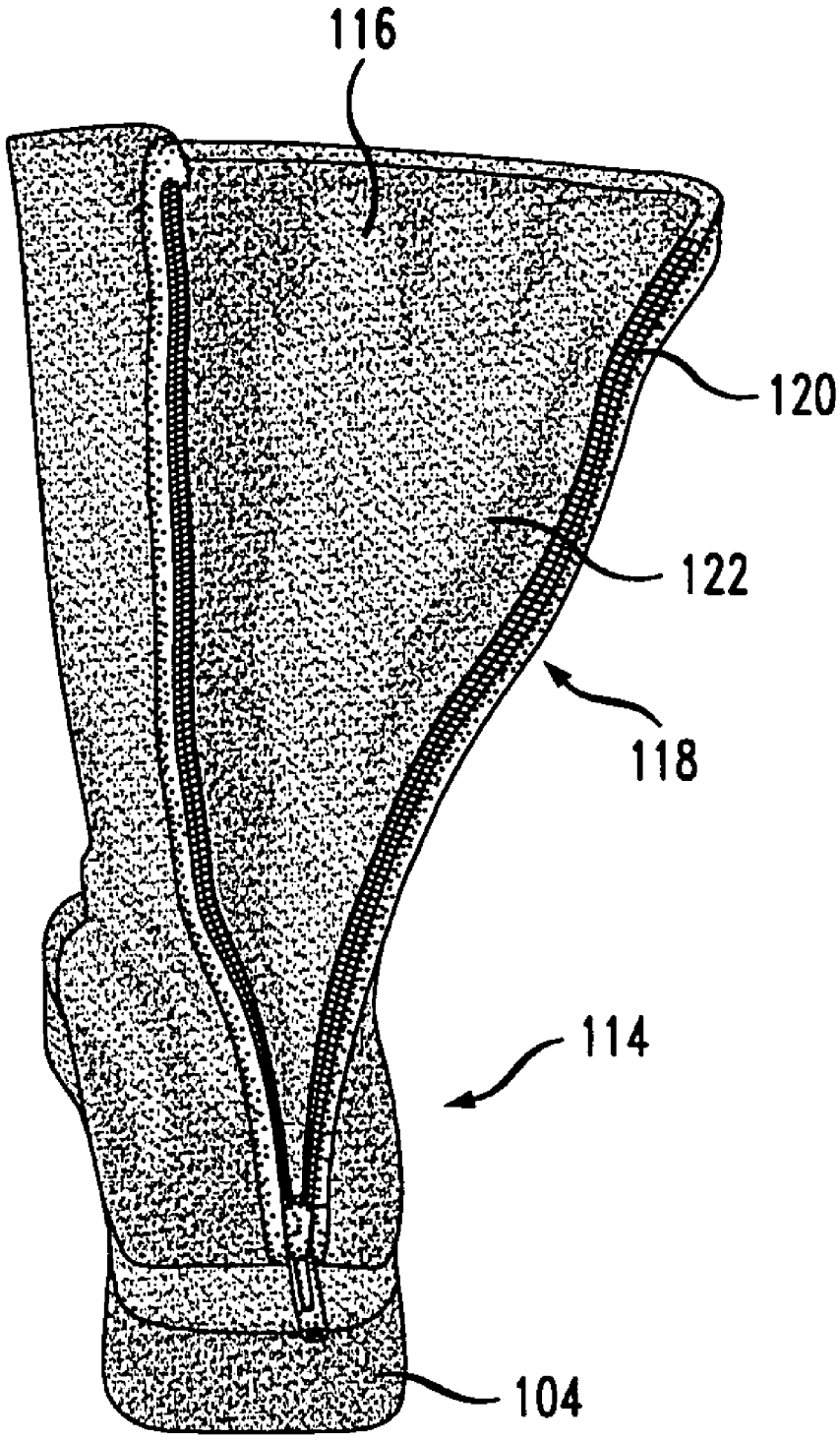
FIG. 12 is a rear view similar to FIG. 11 with the zipper in a full open position.

In particular, reference is made to FIGS. 11 and 12 showing a zipper 120 extending from the top of the boot in proximity to the opening 116 down the full length of the boot to the sole member 104. It will also be observed that it is preferred to have the attachment assembly 118, preferably in the form of a zipper 120, directly anterior of the forward end of the boot to facilitate entry and exit of the user's foot.

Figure 10:
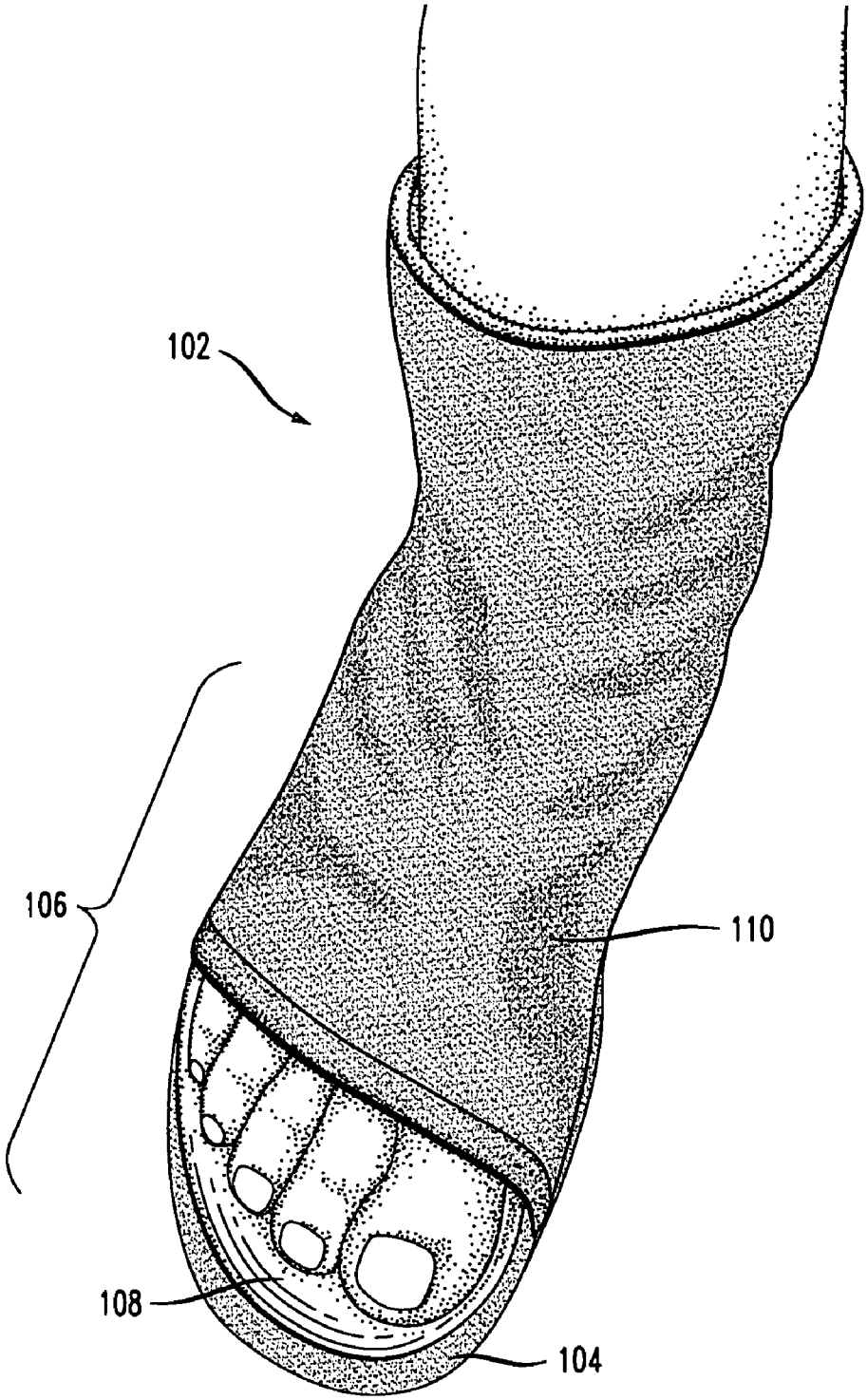
FIG. 10 is a front view of the embodiment shown in FIG. 9 with the forward portion in a lowered position forming a platform on which the toes are placed so that the toes are in an exposed position.

Referring to FIG. 10, there is shown the pedicure boot 102 with the forward portion 108 of the upper member 106 in the lowered position with the toes resting on top of the forward portion 108. In this position, the user can receive a pedicure while the pedicure boot is worn by the user who can wear the pedicure boot upon leaving the pedicure salon with only the toes exposed. It will be observed that the rest of the user's foot is completely covered by the pedicure boot providing protection against inclement weather.

Referring to FIGS. 9 and 10, the operation of the pedicure boot of this embodiment is described as follows. The user may wear the pedicure boot 102 as shown in FIG. 9 where the upper member 106 including the forward portion 108 and the rearward portion 110 forming a foot receiving space that completely protects the user so that the pedicure boot 102 can be worn as a typical boot. When the user is ready to have a pedicure, the boot may be completely removed by running the zipper 120 down the anterior portion 114 of the boot (see FIGS. 11 and 12) so that the user may remove the boot by merely moving the foot backwards away from the forward end of the boot. Alternatively, the user may move the foot only a short distance backward sufficient to move the toes backward away from coverage by the forward portion 108 so that the forward portion 108 may be moved from the raised position shown in FIG. 9 to the lowered position shown in FIG. 10. The user may then move the toes back in place in the boot on top of the forward portion 108 so that only the toes are exposed.

The foregoing embodiments of the invention are illustrative of aspects of the present invention and include modifications that would be routine by those of ordinary skill in the art. For example, the toe spacers can take on a variety of different types of toes spacers including raise projections that emanate from below the surface of the foot receiving space of the sole member. In another routine embodiment, the materials for the pedicure boot can be chosen from leather, synthetic leather, vinyl, suede, cloth, synthetic, and real fur and the like with the forward portion of the upper member preferably being made of a material which is wear resistant and stain resistant especially resistant against stains and deterioration by nail polish and nail polish remover.

What is claimed is:

1. A pedicure boot comprising:

a) a sole member having a sole member forward portion including an upper surface for contacting the user's foot; and b) an upper member operatively engaged to the sole member to form a foot receiving space; said upper member comprising an upper member forward portion and an upper member rearward portion, said upper member forward portion movable from a raised position extending above the sole member forward portion covering a toe portion of the user's foot to a lowered position covering the upper surface of the sole member forward portion wherein when the upper member forward portion is in the lowered position, the toe portion of the user's foot rests on the forward portion of the upper member thereby exposing the toe portion of the user's foot.

2. The pedicure boot of claim 1 wherein the upper member forward portion is made from a material that is wear resistant and at least resistant to damage by at least one of nail polish and nail polish remover.

3. The pedicure boot of claim 2 wherein said material is selected from damage resistant synthetics and leathers having a damage resistant coating.

4. The pedicure boot of claim 3 wherein said material is patent leather.

5. The pedicure boot of claim 1 wherein the upper member forward portion and the upper member rearward portion overlap each other to form an overlap portion when the upper member forward portion is in the raised position.

6. The pedicure boot of claim 5 wherein the overlap portion has a length of no more than about one inch.

7. The pedicure boot of claim 1 wherein the upper member rearward portion further comprises an opening for receiving the foot of the user to enable the foot to enter the foot receiving space and an attachment assembly for reversibly disengaging the upper member rearward portion into separate components to form a longitudinally disposed opening enabling the user to facilitate entering the foot into the foot receiving space.

8. The pedicure boot of claim 7 wherein the attachment assembly is at the rear of the pedicure boot.

9. The pedicure boot of claim 8 wherein the attachment assembly comprises a zipper.

* * * * *